US006837192B2

(12) United States Patent
Shinpo et al.

(10) Patent No.: US 6,837,192 B2
(45) Date of Patent: Jan. 4, 2005

(54) ENGINE COOLING SYSTEM

(75) Inventors: Yoshikazu Shinpo, Nissin (JP); Isao Takagi, Okazaki (JP); Shigetaka Yoshikawa, Aichi-ken (JP); Hiromichi Murakami, Obu (JP); Daisuke Yamamoto, Obu (JP)

(73) Assignees: Toyota Jidosha Kabushiki Kaisha, Toyota (JP); Aisan Kogyo Kabushiki Kaisha, Obu (JP)

( * ) Notice: Subject to any disclaimer, the term of this patent is extended or adjusted under 35 U.S.C. 154(b) by 89 days.

(21) Appl. No.: 10/231,011

(22) Filed: Sep. 3, 2002

(65) Prior Publication Data

US 2003/0047149 A1 Mar. 13, 2003

(30) Foreign Application Priority Data

Sep. 10, 2001 (JP) ..... 2001-272998

(51) Int. Cl.[7] ..... F01P 7/14
(52) U.S. Cl. ..... 123/41.1; 123/41.09
(58) Field of Search ..... 123/41.1, 41.09

(56) References Cited

U.S. PATENT DOCUMENTS 5,390,632 A * 2/1995 Ikebe et al. ..... 123/41.1
6,390,031 B1 * 5/2002 Suzuki et al. ..... 123/41.1

FOREIGN PATENT DOCUMENTS

| | | |
|---|---|---|
| JP | A 08-151922 | 6/1996 |
| JP | A 10-317965 | 12/1998 |
| JP | A 2000-345842 | 12/2000 |

* cited by examiner

*Primary Examiner*—Noah P. Kamen
(74) *Attorney, Agent, or Firm*—Oliff & Berridge, PLC

(57) ABSTRACT

An engine cooling system includes a flow control valve and an electronic control unit (ECU) for controlling the flow control valve. The flow control valve regulates the flow rate of coolant flowing through a radiator in a coolant circuit. The ECU feedback controls the opening size of the flow control valve such that the temperature of coolant at an engine outlet seeks a predetermined target value. During the feedback control, the ECU controls the flow control valve such that the opening size of the flow control valve remains above a predetermined lowest value. As a result, the flow control valve is prevented from falling in a small opening size range in which in which it is difficult to cause the engine outlet coolant temperature to seek the target value, and the engine outlet coolant temperature is favorably adjusted.

19 Claims, 9 Drawing Sheets

ENGINE COOLING SYSTEM

BACKGROUND OF THE INVENTION

The present invention relates to engine cooling systems.

Generally, a water cooling type engine of a vehicle includes a cooling system provided with a radiator and a flow control valve. The radiator is located in an engine coolant circuit for cooling the coolant. The flow control valve regulates the flow of the coolant that passes through the radiator. The flow control valve is controlled to change the coolant flow in the radiator (hereafter, "the radiator flow"). This adjusts the temperature of the coolant, which cools the engine.

For example, Japanese Laid-Open Patent No. 10-317965 describes a known control procedure of the flow control valve. According to the procedure, the flow control valve is fully closed to minimize the radiator flow when the coolant temperature is relatively low. In contrast, when the coolant temperature is relatively high, the flow control valve is fully opened to maximize the radiator flow. Otherwise, a feedback control procedure is performed to vary the opening size of the flow control valve (the radiator flow) depending on the coolant temperature, such that the coolant temperature seeks a predetermined target value.

Thus, when the coolant temperature is relatively low, such as, if the engine has been started immediately before, the flow control valve is held in a fully closed state to warm up the engine quickly. Afterwards, when the coolant temperature rises to a relatively high level, feedback controlling is started such that the coolant temperature seeks the target value.

During the feedback controlling, if the opening size of the flow control valve falls in a range close to the fully closed state, or a relatively low opening size range, under a certain condition, the opening size of the flow control valve is adjusted in this range such that the coolant temperature seeks the target value. However, when the flow control valve is in the relatively low opening size range, the coolant temperature may change excessively with respect to the opening size adjustment of the flow control valve. This causes hunting in the coolant temperature, thus reducing the reliability of the feedback controlling of the flow control valve for adjusting the coolant temperature to the target value.

Also, as long as the opening size of the flow control valve remains in the relatively low range, changing of the radiator flow in response to the opening size adjustment of the flow control valve may become insufficient, depending on the flow characteristics of the flow control valve. For example, if the opening size of the flow control valve is decreased in the relatively low range by the feedback controlling to raise the coolant temperature to the target value, the coolant temperature does not rise sufficiently quickly. The opening size of the flow control valve is thus excessively reduced by the feedback controlling. In this case, if the engine operational state changes later such that the radiator flow, or the opening size of the flow control valve, must be increased, increasing of the opening size of the flow control valve is delayed. This causes overshooting of the coolant temperature, thus decreasing the reliability of the feedback controlling of the flow control valve for adjusting the coolant temperature to the target value. By contrast, if the opening size of the flow control valve is increased in the relatively low range by the feedback controlling to lower the coolant temperature to the target value, the coolant temperature does not drop sufficiently quickly. The opening size of the flow control valve is thus excessively increased by the feedback controlling. In this case, if the engine operational state changes later such that the radiator flow, or the opening size of the flow control valve, must be reduced, decreasing of the opening size of the flow control valve is delayed. This causes undershooting of the coolant temperature, thus decreasing the reliability of the feedback controlling of the flow control valve for adjusting the coolant temperature to the target value.

Further, in the feedback controlling of the flow control valve, delay is caused in the response of the radiator flow, or the coolant temperature, with respect to the adjustment of the opening size of the flow control valve. Such a delay decreases the efficiency for adjusting the coolant temperature to the target value by the feedback controlling. The controlling reliability of the coolant temperature with respect to the target value is thus decreased.

SUMMARY OF THE INVENTION

Accordingly, it is an objective of the present invention to provide an engine cooling system that maintains reliability of feedback controlling of a flow control valve for adjusting the coolant temperature to a target value.

To achieve the foregoing and other objectives and in accordance with the purpose of the present invention, the invention provides an engine cooling system that includes a coolant circuit, which extends through an engine, a radiator, which is provided in the coolant circuit and cools coolant passing through the coolant circuit, a flow control valve, which regulates the flow rate of coolant flowing through the radiator, and a controller. The controller feedback controls the opening size of the flow control valve such that an engine coolant temperature, which is the temperature of coolant passing through the engine, seeks a predetermined target value.

In one aspect of the present invention, during the feedback control, the controller controls the flow control valve such that the opening size of the flow control valve remains above a predetermined lowest value.

In another aspect of the present invention, when the engine coolant temperature shifts from increasing to decreasing during the feedback control, the controller decreases the opening size of the flow control valve by a predetermined amount from the current opening size. When the engine coolant temperature shifts from decreasing to increasing during the feedback control, the controller increases the opening size of the flow control valve by a predetermined amount from the current opening size.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objectives and advantages thereof, may best be understood by reference to the following description of the presently preferred embodiments together with the accompanying drawings in which.

DETAILED DESCRIPTION OF THE PREFERRED EMBODIMENTS

A first embodiment of the present invention applied to an automobile engine will now be described with reference to FIGS. 1 to 7.

Figure 1:
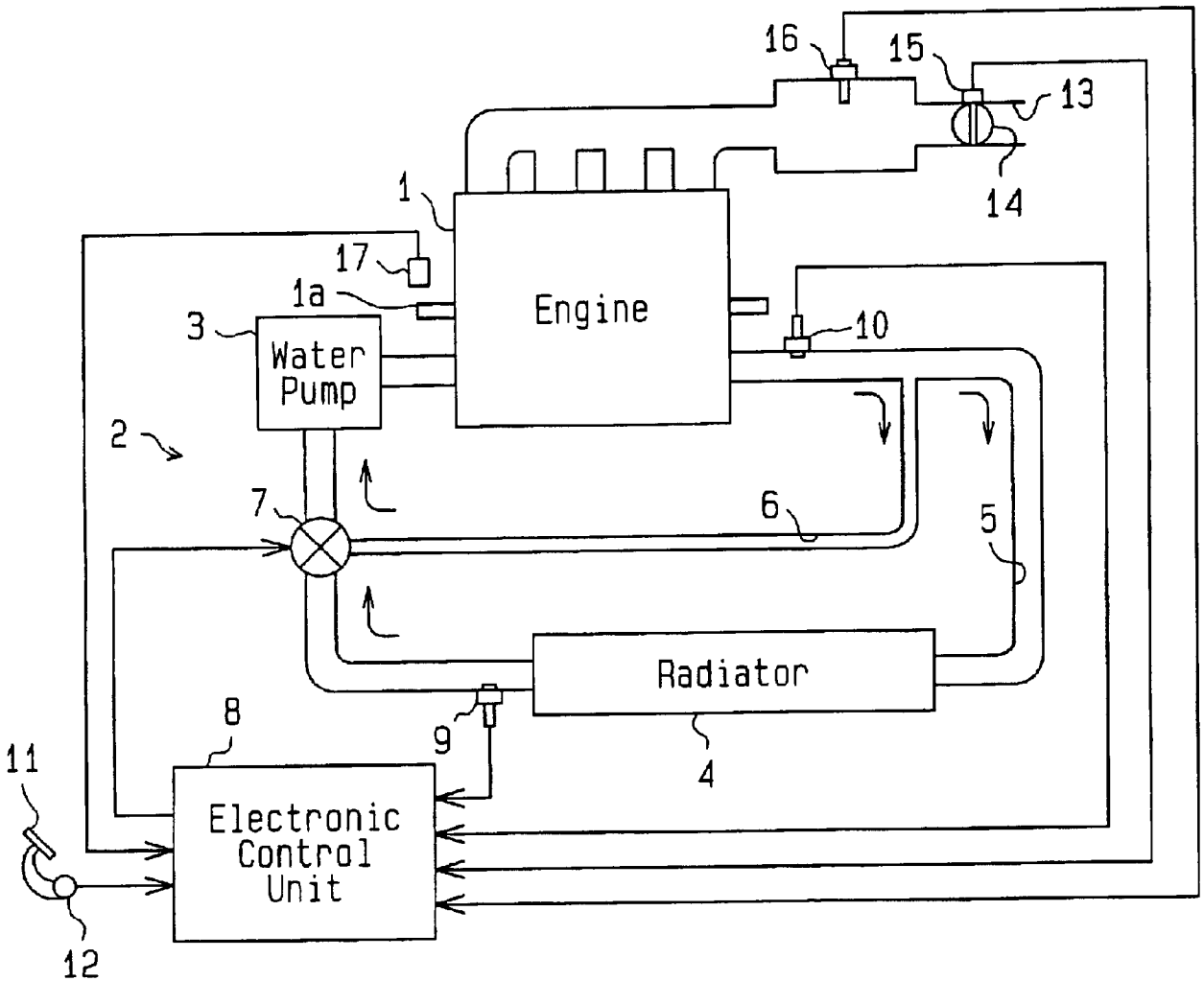
FIG. 1 is a view schematically showing the structure of an engine cooling system according to an embodiment of the present invention as a whole.

With reference to FIG. 1, a cooling system of an engine 1 includes a coolant circuit 2 for circulating coolant such that the coolant passes through the engine 1. The coolant circuit 2 includes a water pump 3, which is driven by the engine 1. When the water pump 3 is activated, the coolant flows in the coolant circuit 2 in a rightward rotational direction, as viewed in the drawing. The coolant thus passes through a cylinder block and a cylinder head (neither is illustrated) of the engine 1. This transmits heat from the engine 1 to the coolant, thus cooling the engine 1.

The coolant circuit 2 has two branches downstream of the engine 1, which are merged into a single flow at a position upstream of the water pump 3. One of the branches forms a radiator line 5, and the other a bypass 6. The radiator line 5 sends coolant to a radiator 4 and recirculates the coolant to the engine 1 after the coolant is cooled by the radiator 4. The bypass 6 sends coolant to the engine 1 without passing the coolant through the radiator 4. A flow control valve 7 is formed at a position at which the radiator line 5 and the bypass 6 are merged into the single flow. The flow control valve 7 regulates the flow of the coolant in the radiator line 5 and the flow of the coolant in the bypass 6. The flow control valve 7 is configured to gradually increase the coolant flow in the radiator line 5 as the opening size of the flow control valve 7 becomes larger.

More specifically, the flow control valve 7 adjusts the coolant flow in the radiator line 5 to control the temperature of the coolant for cooling the engine 1. In other words, if the coolant flow in the radiator 5 is increased, the proportion of the coolant cooled by the radiator 4 is raised, with respect to the total flow of the coolant that flows to the engine 1 in the coolant circuit 2. This lowers the temperature of the coolant that cools the engine 1. In contrast, if the coolant flow in the radiator 5 is decreased, the proportion of the coolant cooled by the radiator 4 is lowered, with respect to the total flow of the coolant that flows to the engine 1 in the coolant circuit 2. This raises the temperature of the coolant that cools the engine 1.

An electronic control unit (ECU) 8, which is installed in the vehicle, drives and controls the flow control valve 7. The electronic control unit 8 receives detection signals from the following sensors:

A radiator coolant temperature sensor 9 for detecting the coolant temperature downstream of the radiator 4 in the radiator line 5;

An engine coolant temperature sensor 10 for detecting the coolant temperature at an outlet of the coolant circuit 2 from the engine 1;

An accelerator position sensor 12 for detecting the depression amount of an accelerator pedal 11 (the accelerator depression amount), which is depressed by the vehicle's driver;

A throttle position sensor 15 for detecting the opening size of a throttle valve 14 (the throttle opening size), which is located in an intake passage 13 of the engine 1;

A vacuum sensor 16 for detecting the pressure downstream of the throttle position sensor 15 in the intake passage 13 (the intake pressure): and A crank position sensor 17 for outputting a signal reflecting rotation of a crankshaft 1*a,* or an output shaft of the engine 1.

The electronic control unit 8 fully closes the flow control valve 7 to warm up the engine 1, if, for example, the engine 1 has been started immediately before and is not yet completely warmed up. When the engine 1 is completely warmed up, or, for example, the coolant temperature at an outlet of the coolant circuit 2 from the engine 1 (hereafter, engine outlet coolant temperature) becomes higher than or equal to 80 degrees Celsius, feedback controlling of the flow control valve 7 is performed in accordance with the engine outlet coolant temperature, such that the engine outlet coolant temperature seeks a predetermined target value. The engine outlet coolant temperature is obtained in accordance with a detection signal generated by the engine coolant temperature sensor 10.

Figure 2:
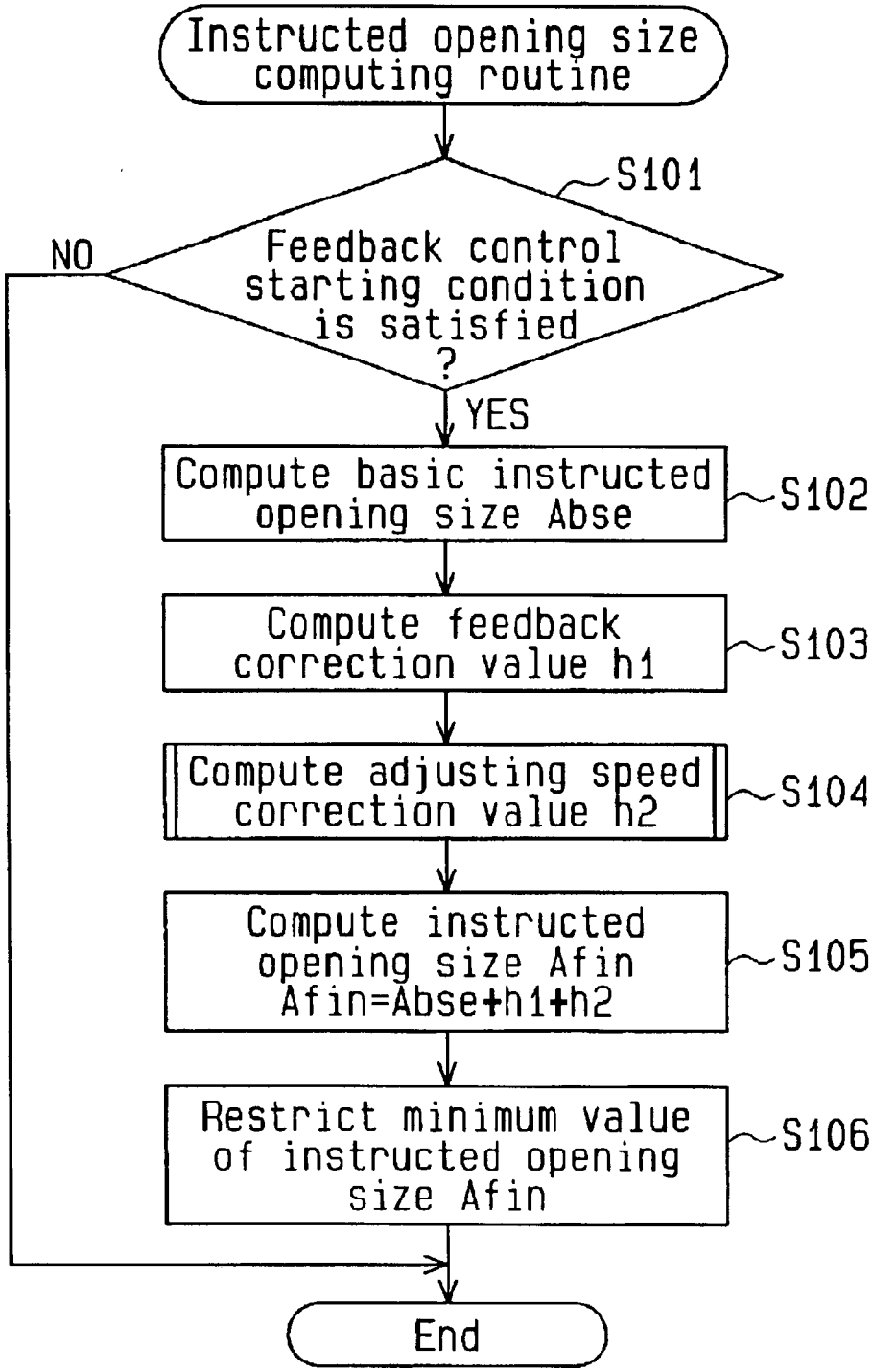
FIG. 2 is a flowchart indicating an instructed opening size computing procedure according to the first embodiment.

The feedback controlling is performed by adjusting the opening size of the flow control valve 7 based on an instructed opening size Afin, which is obtained depending on, for example, the engine outlet coolant temperature. The computing procedure for the instructed opening size Afin will hereafter be explained with reference to the flowchart of FIG. 2, which indicates the corresponding routine. The instructed opening size computing procedure of FIG. 2 is periodically conducted by the electronic control unit 8 with interruption at predetermined time intervals.

If the engine outlet coolant temperature is higher than or equal to 80 degrees Celsius, the condition for starting the feedback controlling is satisfied (S101: YES). In this case, a basic instructed opening size Abse, a feedback correction value h1, and an adjusting speed correction value h2, which are used for computing the instructed opening size Afin, are obtained in this order (in steps S102, S103, and S104). The instructed opening size Afin is computed by the following equation (1), using the basic instructed opening size Abse, the feedback correction value h1, and the adjustment correction value h2 (in step S105):

$$Afin=Abse+h1+h2 \quad (1)$$

Afin: Instructed opening size

Abse: Basic instructed opening size h1: Feedback correction value h2: Adjustment speed correction value In the equation (1), the basic instructed opening size Abse is computed in relation to the coolant temperature at an outlet of the coolant circuit 2 from the radiator 4 (hereafter, the radiator outlet coolant temperature), the engine speed, and the engine load. More specifically, the basic instructed opening size Abse is a theoretical opening size of the flow control valve 7 that is needed for cooling the engine 1 in accordance with the current operation state of the engine 1.

The radiator outlet coolant temperature is obtained in accordance with a detection signal generated by the radiator coolant temperature sensor 9. The engine speed is determined in accordance with a detection signal generated by the crank position sensor 17. The engine load is determined in relation to a parameter that is varied depending on the engine speed and the air intake of the engine 1. The parameter may be the accelerator depression amount based on a detection signal of the accelerator position sensor 12, the throttle opening size based on a detection signal of the throttle position sensor 15, or the intake pressure based on a detection signal of the vacuum sensor 16.

The feedback correction value h1 is variable with respect to "0" depending on the difference between the engine outlet coolant temperature and its target value, such that the engine outlet coolant temperature becomes the target value. More specifically, if the engine outlet coolant temperature is lower than the target value, the feedback correction value h1 is gradually decreased by predetermined amounts x at predetermined time intervals to reduce the instructed opening size Afin. In contrast, if the engine outlet coolant temperature is higher than the target value, the feedback correction value h1 is gradually increased by the amounts x at predetermined time intervals to increase the instructed opening size Afin.

The adjusting speed correction value h2 is determined for improving the efficiency for adjusting the engine outlet coolant temperature to the target value. The adjusting speed correction value h2 is obtained by an adjusting speed correction value computing routine of FIGS. 5 and 6, which will be later described.

The opening size of the flow control valve 7 is controlled based on the instructed opening size Afin, which is obtained as described above, such that the engine outlet coolant temperature seeks the target value. However, during the feedback controlling, the opening size of the flow control valve may be decreased to a value close to the fully closed state under a certain condition, for example, when the radiator outlet coolant temperature is relatively low or the engine 1 is in an operation state in which heat generation is relatively low. If the opening size of the flow control valve 7 is adjusted in a relatively low range close to the fully closed state, the engine outlet coolant temperature does not change appropriately in response to the adjustment of the opening size of the flow control valve 7.

This problem is caused depending on the flow characteristics of the flow control valve 7, or the changing characteristics of the coolant flow in the radiator line 5 in response to the opening size adjustment of the flow control valve 7, and the changing characteristics of the engine outlet coolant temperature in response to the opening size adjustment of the flow control valve 7. The factors that cause the aforementioned problem will hereafter be explained with reference to FIGS. 3 and 4. The graphs of FIGS. 3 and 4 respectively indicate the changing characteristics of the coolant flow in the radiator line 5 and the changing characteristics of the engine outlet coolant temperature, in response to the opening size adjustment of the flow control valve 7, when the operation state of the engine 1 remains constant.

Figure 3:
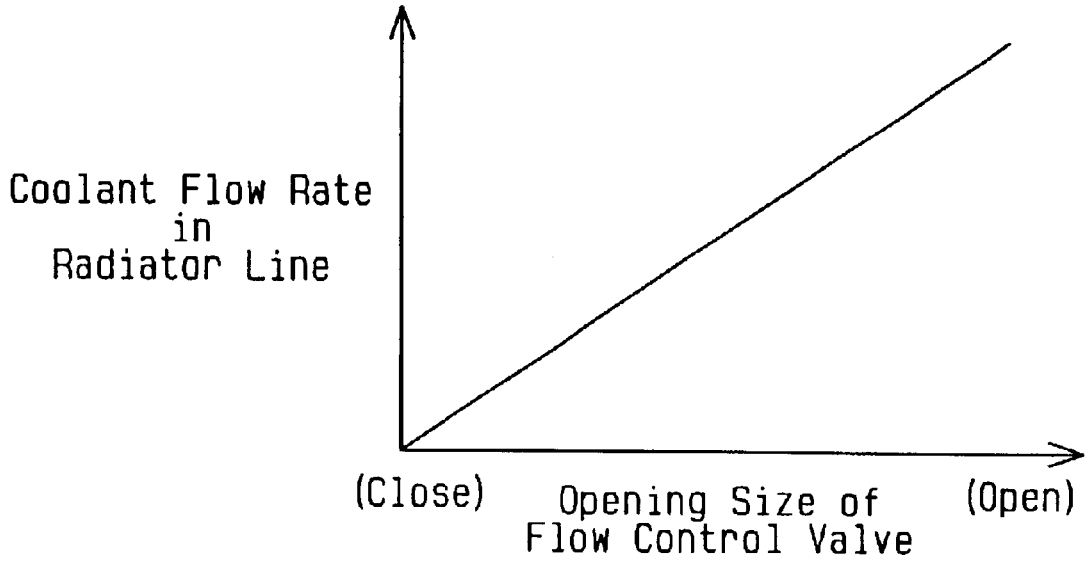
FIG. 3 is a graph indicating changing of the coolant flow in a radiator line with respect to adjustment of the opening size of a flow control valve according to the first embodiment.
Figure 4:
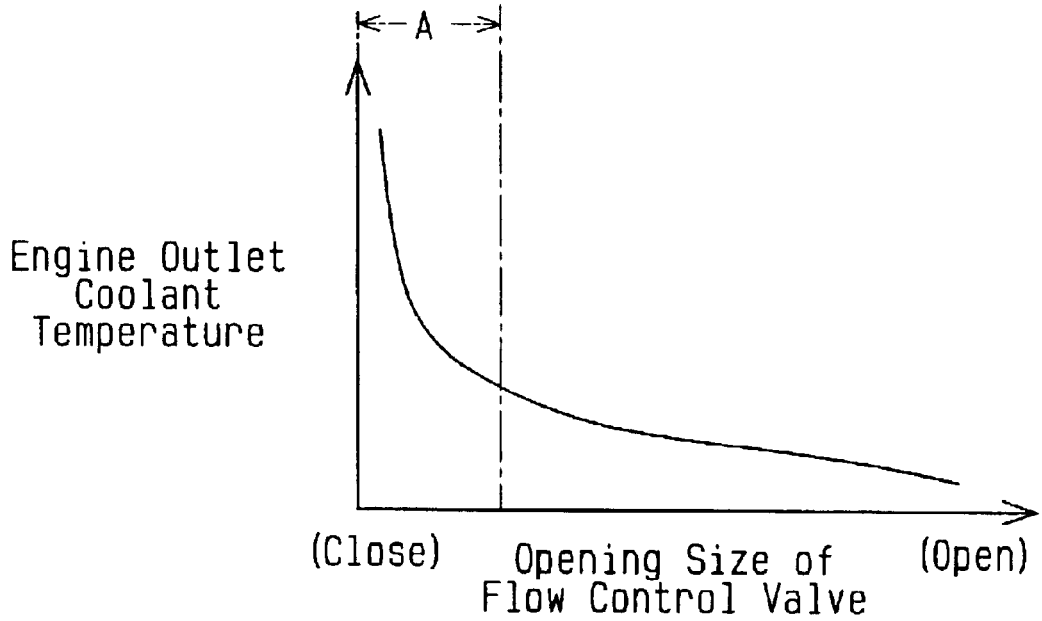
FIG. 4 is a graph indicating changing of engine outlet coolant temperature with respect to the adjustment of the opening size of the flow control valve according to the first embodiment.

With reference to FIG. 3, the flow control valve 7 of the first embodiment indicates the flow characteristics that the coolant flow in the radiator line 5 is gradually increased at a constant rate as the opening size of the flow control valve 7 becomes greater. The engine outlet coolant temperature is changed in response to increasing of the opening size of the flow control valve 7, as indicated in FIG. 4. More specifically, when the opening size of the flow control valve 7 is adjusted in a relatively low range close to the fully closed state (the range A of FIG. 4), the engine outlet coolant temperature changes excessively in response to the opening size adjustment of the flow control valve 7. This may be one of the factors that cause the aforementioned problem.

Further, when the opening size of the flow control valve 7 remains in the relatively low range close to the fully closed state, the coolant flow in the radiator line 5 is nullified or significantly reduced. Thus, only the coolant near the radiator coolant temperature sensor 9 and the engine coolant temperature sensor 10 is warmed by heat generated by, for example, an exhaust pipe of the engine 1. In this case, the detection signals of the coolant temperature sensors 9, 10 become inappropriate and the feedback controlling, which is performed depending on these detection signals, also becomes inappropriate. This may also be one of the factors that cause the aforementioned problem.

Accordingly, in the instructed opening size computing routine of FIG. 2 of the first embodiment, a minimum value of the instructed opening size Afin is restricted for preventing the instructed opening size Afin computed in step S105 from falling in the range A, or the relatively low opening size range. In other words, if the instructed opening size Afin obtained in step S105 falls in the range A, the instructed opening size Afin is set to a predetermined minimum value that is larger than the range A (the relatively low opening size range) in step S106. The feedback controlling of the flow control valve 7 is conducted based on the corrected instructed opening size Afin. Thus, the opening size adjustment of the flow control valve 7 in the range A, which is close to the fully closed state, is avoided.

Figure 5:
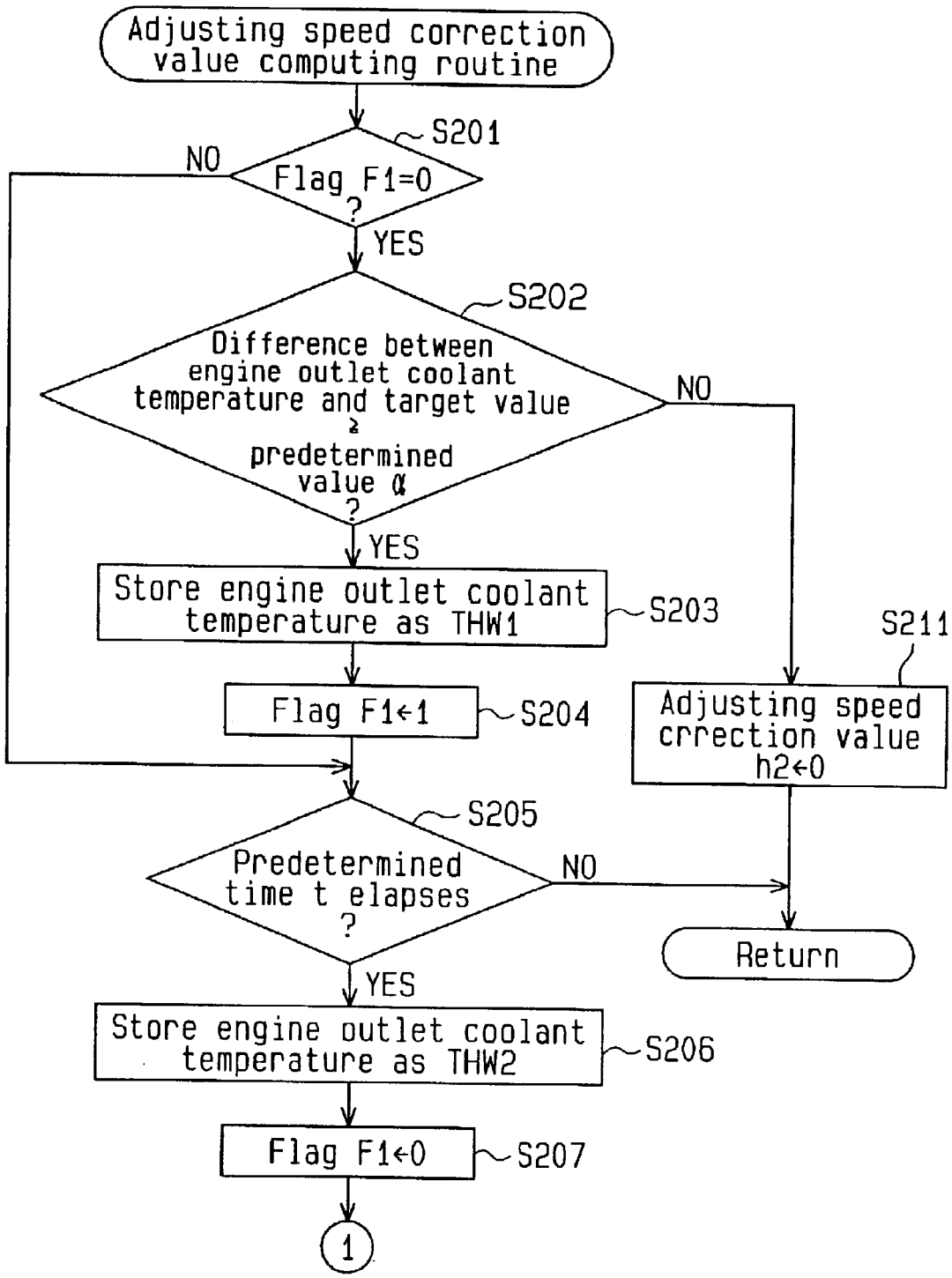
FIG. 5 is a flowchart indicating an adjusting speed correction value computing procedure.
Figure 6:
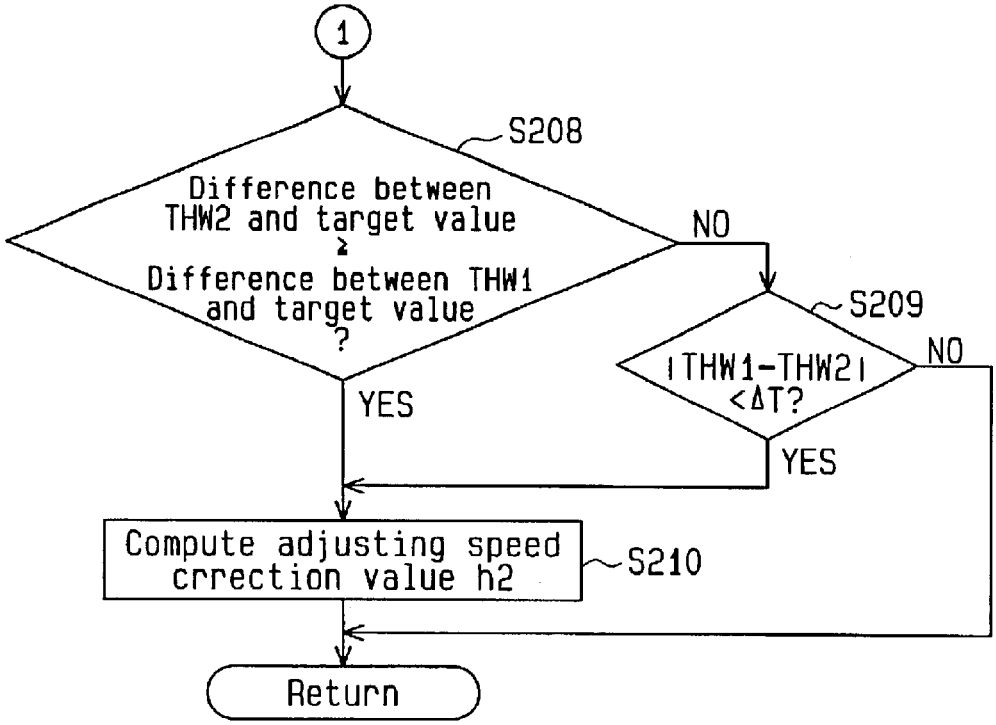
FIG. 6 is a flowchart indicating the adjusting speed correction value computing procedure.
Figure 7:
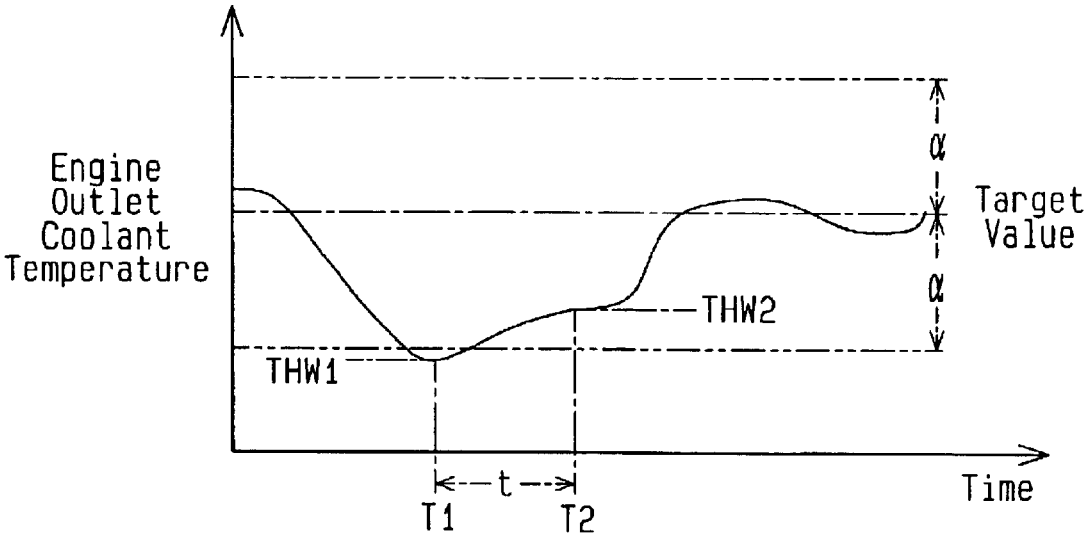
FIG. 7 is a timing chart indicating the changing of the engine outlet coolant temperature as time elapses.

Next, step S104, or the computing procedure of the adjusting speed correction value h2, will be explained with reference to FIGS. 5, 6, and 7. FIGS. 5, 6 are flowcharts indicating the adjusting speed correction value computing routine. FIG. 7 is a graph indicating variation of the engine outlet coolant temperature as time elapses. The computing routine of FIGS. 5 and 6 is conducted by the electronic control unit 8, every time step S104 of the instructed opening size computing routine (FIG. 2) is performed.

In the adjusting speed correction value computing routine, it is judged whether or not the adjusting efficiency of the engine outlet coolant temperature with respect to the target value need be improved. In step S201, a flag F1 indicates whether or not the judgment is currently being carried out. If the flag F1 is "0", it is indicated that the judgment is not currently being carried out (S201: YES). In this case, it is judged whether or not the difference between the engine outlet coolant temperature and its target value is greater or equal to a predetermined value α (in step S202). If the judgment of S202 is negative (S202: NO), the adjusting speed correction value h2 is set at "0" in step S211, and the instructed opening size computing routine of FIG. 2 is resumed. In this case, the adjusting efficiency of the engine outlet coolant temperature remains unchanged.

In contrast, if the judgment of S202 is positive, or it is judged that the difference between the engine outlet coolant temperature and its target value is greater than or equal to the value α (at timing T1 of FIG. 7), the current engine outlet coolant temperature is stored as a coolant temperature THW1 (in step S203). Further, in step S204, the flag F1 is set at "1". Subsequently, when a predetermined time t elapses after the setting of the flag F1 to "1" (at timing T2 of FIG. 7), the judgment of step S205 turns positive. The current engine outlet coolant temperature is then stored as a coolant temperature THW2 in step S206.

Subsequently, in step S207, the flag F1 is set to "0", which indicates that the judgment is not currently being carried out. Afterwards, in steps S208 and S209 of FIG. 6, whether the adjusting efficiency of the engine outlet coolant temperature with respect to the target value need be improved or not is judged depending on the coolant temperatures THW1 and THW2. More specifically, the judgments of steps S208 and S209 are based on the following points:

In step S208, it is judged whether or not the difference between the coolant temperature THW2 and the target value is more than or equal to the difference between the coolant temperature THW1 and the target value, indicating that the adjustment of the engine outlet coolant temperature to the target value cannot be achieved under the current conditions; and In step S209, it is judged whether or not the difference between the coolant temperatures THW1 and THW2 (the change of the engine outlet coolant temperature during the time t) is less than a predetermined value ΔT, indicating that the adjusting speed of the engine outlet coolant temperature with respect to the target value is excessively slow.

If the judgments of steps S208 and S209 are both negative, it is indicated that the adjusting efficiency of the engine outlet coolant temperature with respect to the target value is currently maintained at a relatively high level. Thus, it is judged that the adjusting efficiency of the engine outlet coolant temperature need not be further improved. In this case, the adjusting speed correction value h2 is maintained at "0", and the instructed opening size computing routine of FIG. 2 is resumed.

By contrast, if one of the judgments of steps S208 and S209 is positive, it is indicated that the adjusting efficiency of the engine outlet coolant temperature with respect to the target value is currently low. Thus, it is judged that the adjusting efficiency of the engine outlet coolant temperature need be improved. In this case, the adjusting speed correction value h2 is computed based on the difference between the current engine outlet coolant temperature and the target value (step S210).

More specifically, if the engine outlet coolant temperature is higher than the target value, the adjusting speed correction value h2 is gradually increased with respect to "0" (to increase the instructed opening size Afin) as the difference between the engine outlet coolant temperature and the target value becomes larger. In contrast, if the engine outlet coolant temperature is lower than the target value, the adjusting speed correction value h2 is gradually decreased with respect to "0" (to decrease the instructed opening size Afin) as the difference between the engine outlet coolant temperature and the target value becomes larger.

When the computation of the adjusting speed correction value h2 is completed, the instructed opening size computing routine of FIG. 2 is resumed. In the routine, the instructed opening size Afin is determined using the adjusting speed correction value h2. The opening size of the flow control valve 7 is controlled based on the obtained, instructed opening size Afin, thus improving the adjusting efficiency of the engine outlet coolant temperature with respect to the target value. Accordingly, for example, following the timing T2 of FIG. 7, the engine outlet coolant temperature is quickly adjusted to the target value, as indicated by the solid line in the timing chart.

The first embodiment has the following effects.

(1) In the first embodiment, the minimum value of the instructed opening size Afin is restricted such that the instructed opening size Afin does not fall in the relatively low range close to the fully closed state, or the range A of FIG. 4, in which the engine outlet coolant temperature changes excessively in response to the opening size adjustment of the flow control valve 7. The opening size adjustment of the flow control valve 7 is thus prevented from being performed in the range A during the feedback controlling. This suppresses hunting of the engine outlet coolant temperature, and therefore improves the reliability of the feedback controlling for adjusting the engine outlet coolant temperature to the target value.

(2) In the feedback controlling, the adjusting speed correction value h2 is increased or decreased with respect to "0", if the adjusting speed of the engine outlet coolant temperature is excessively slow or the adjustment of the engine outlet coolant temperature cannot be achieved. The opening size of the flow control valve 7 (the instructed opening size Afin) is thus corrected such that the engine outlet coolant temperature is adjusted to a value close to the target value. Accordingly, the engine outlet coolant temperature quickly seeks the target value.

(3) The adjusting speed correction value h2, which serves for improving the adjusting efficiency of the engine outlet coolant temperature with respect to the target value, is varied in relation to the difference between the current engine outlet coolant temperature and the target value. The opening size adjustment of the flow control valve 7 based on the adjusting speed correction value h2 is thus appropriately conducted. Accordingly, the engine outlet coolant temperature seeks the target value further quickly.

Next, a second embodiment of the present invention will be described with reference to FIGS. 8 and 9.

The flow control valve 7 of the second embodiment has flow characteristics that are different from those of the flow control valve 7 of the first embodiment. In the second embodiment, the minimum value of the instructed opening size Afin is set in a different manner from that of the first embodiment.

Figure 8:
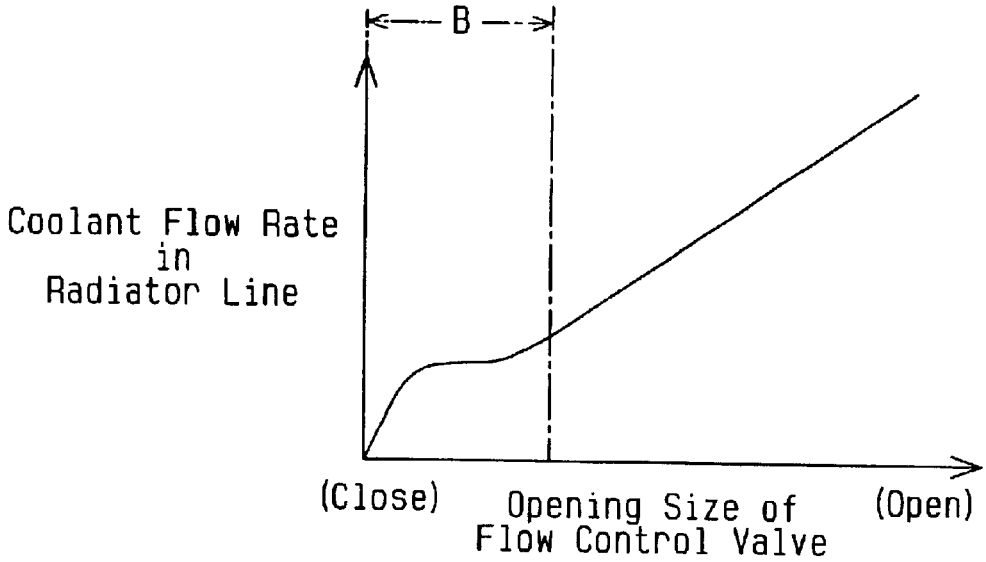
FIG. 8 is a graph indicating the changing of the coolant flow in the radiator line with respect to the adjustment of the opening size of the flow control valve according to a second embodiment.
Figure 9:
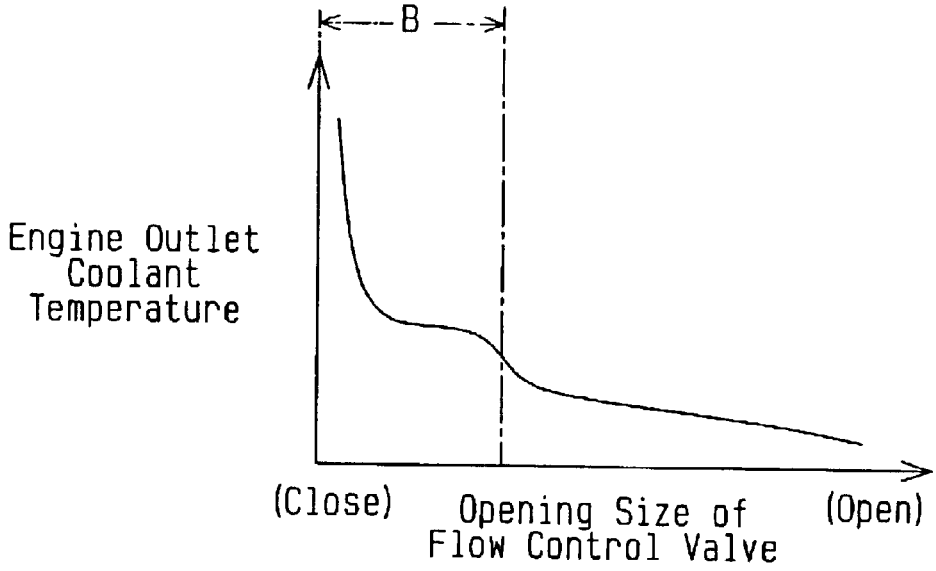
FIG. 9 is a graph indicating the changing of the engine outlet coolant temperature with respect to the adjustment of the opening size of the flow control valve according to the second embodiment.

The graphs of FIGS. 8 and 9 respectively indicate the changing characteristics of the coolant flow in the radiator line 5 and the changing characteristics of the engine outlet coolant temperature, in response to the opening size adjustment of the flow control valve 7 of the second embodiment, when the operation state of the engine 1 is constant.

With reference to FIG. 8, the flow control valve 7 has the flow characteristics as follows. That is, the flow control valve 7 of the second embodiment is configured to gradually increase the coolant flow in the radiator line 5 as the opening size of the flow control valve 7 becomes larger. However, when the opening size of the flow control valve 7 falls in a part of a relatively low range, or a part of a range B of FIG. 8, increasing of the coolant flow in the radiator line 5 in response to the opening size adjustment of the flow control valve 7 is almost completely suppressed. Further, the engine outlet coolant temperature is varied in response to the opening size adjustment of the flow control valve 7, as indicated by FIG. 9. More specifically, changing of the engine outlet coolant temperature in response to the opening size adjustment of the flow control valve 7 occurs excessively slowly (or is almost completely suppressed), when the opening size of the flow control valve 7 is in the portion of the relatively low range (the range B).

Thus, when the opening size of the flow control valve 7 is adjusted by the feedback controlling in the portion of the range B such that the engine outlet coolant temperature seeks the target value, the changing amount of the engine outlet coolant temperature in response to the opening size adjustment of the flow control valve 7 becomes excessively small. The opening size of the flow control valve 7 is thus excessively changed. In this case, when the engine 1 is operated in a different operation state later and the opening size of the flow control valve 7 needs to be further adjusted, the opening size adjustment of the flow control valve 7 cannot be achieved quickly. This causes overshooting or undershooting in the engine outlet coolant temperature, thus reducing the reliability of the feedback controlling for adjusting the engine outlet coolant temperature to the target value.

Accordingly, in the second embodiment, the minimum value of the instructed opening size Afin is restricted such that the instructed opening size Afin dose not fall in the range B. The flow control valve 7 is controlled in accordance with the instructed opening size Afin that is set to the restricted minimum value. This prevents the opening size adjustment of the flow control valve 7 from being performed in the range B for adjusting the engine outlet coolant temperature to the target value.

The second embodiment has the following effect.

(4) In the second embodiment, the minimum value of the instructed opening size Afin is restricted such that the instructed opening size Afin does not fall in the relatively low range close to the fully closed state, or the range B of FIG. 9, in which the changing amount of the engine outlet coolant temperature in response to the opening size adjustment of the flow control valve 7 becomes excessively small. The opening size adjustment of the flow control valve 7 is thus prevented from being performed in the range B during the feedback controlling. This suppresses excessive adjustment of the opening size of the flow control valve 7, and therefore improves the reliability of the feedback controlling for adjusting the engine outlet coolant temperature to the target value.

A third embodiment of the present invention will hereafter be described with reference to FIGS. 10 to 14.

In the feedback controlling of the first or second embodiment, delay is caused in the response of the engine outlet coolant temperature with respect to the adjustment of the opening size of the flow control valve 7 based on the instructed opening size Afin. This reduces the adjusting efficiency of the engine outlet coolant temperature with respect to the target value. Thus, in the third embodiment, when variation of the engine outlet coolant temperature is shifted between increasing and decreasing during the feedback controlling, the opening size of the flow control valve 7 is changed in accordance with a skipping amount S, which will be later described, such that the engine outlet temperature quickly seeks the target value.

As described, the opening size of the flow control valve 7 is adjusted in accordance with the instructed opening size Afin. In the third embodiment, the instructed opening size Afin is computed using the skipping amount S, in addition to the basic opening size Abse, the feedback correction value h1, and the adjusting speed correction value h2. More specifically, the instructed opening size Afin of the third embodiment is obtained by the following equation (2):

$$Afin = Abse + h1 + h2 + S \quad (2)$$

Afin: Instructed opening size
Abse: Basic instructed opening size
h1: Feedback correction value
h2: Adjustment speed correction value
S: Skipping amount The initial value of the skipping amount S is, for example, "0". The skipping amount S is computed as a negative value when the variation of the engine outlet coolant temperature is shifted from increasing to decreasing. In contrast, the skipping amount S is computed as a positive value when the variation of the engine outlet coolant temperature is shifted from decreasing to increasing. The instructed opening size Afin is obtained in accordance with the skipping amount S, which is determined as described. In other words, when the variation of the engine outlet coolant temperature is shifted between increasing and decreasing, the opening size of the flow control valve 7 is changed in accordance with the skipping amount S.

Figure 10:
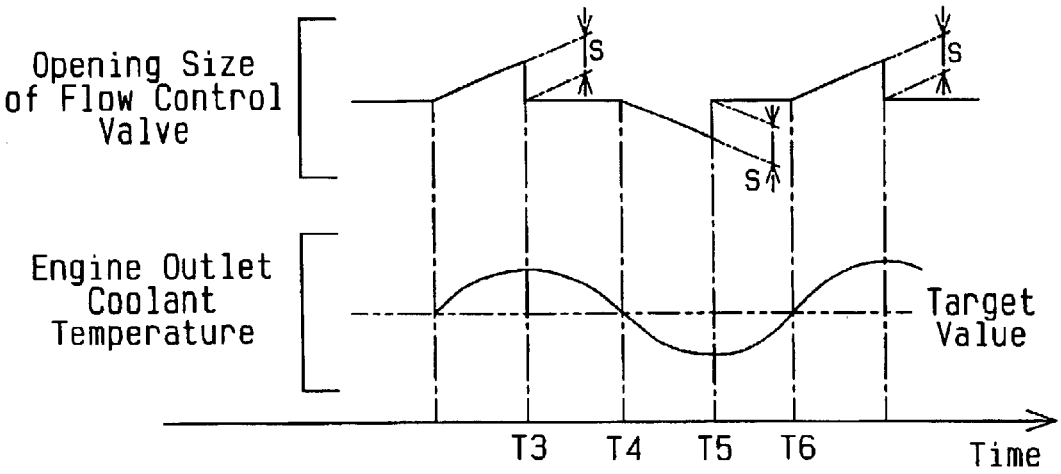
FIG. 10 is a timing chart indicating the variation of the opening size of the flow control valve and the variation of the engine outlet coolant temperature as time elapses.

The opening size adjustment of the flow control valve 7 in accordance with the skipping amount S will hereafter be explained with reference to the timing chart of FIG. 10. FIG. 10 indicates the variation of the opening size of the flow control valve 7 as time elapses, and the variation of the engine outlet coolant temperature as time elapses.

With reference to the timing chart, after the engine outlet coolant temperature becomes higher than the target value, the variation of the engine outlet coolant temperature is shifted from increasing to decreasing (at timing T3). The opening size of the flow control valve 7 is then reduced in accordance with the skipping amount S. The flow control valve 7 is fixed at the reduced opening size until after the engine outlet coolant temperature reaches the target value (at timing T4). The engine outlet coolant temperature thus decreases rapidly from the level higher than the target value to the target value. After the engine outlet coolant temperature reaches the target value (at timing T4), the fixing of the opening size of the flow control valve 7 is stopped. That is, the opening size adjustment of the flow control valve 7 is resumed such that the engine outlet coolant temperature seeks the target value.

Afterwards, when the engine outlet coolant temperature becomes lower than the target value, the variation of the engine outlet coolant temperature is shifted from decreasing to increasing (at timing T5). The opening size of the flow control valve 7 is then increased in accordance with the skipping amount S. The flow opening valve 7 is fixed at the increased opening size until after the engine outlet coolant temperature reaches the target value (at timing T6), in the same manner as above. The engine outlet coolant temperature thus increases rapidly from the level lower than the target value to the target value. After the engine outlet coolant temperature reaches the target value (at timing T6), the fixing of the opening size of the flow control valve 7 is stopped. That is, the opening size adjustment of the flow control valve 7 is resumed such that the engine outlet coolant temperature seeks the target value.

Figure 11:
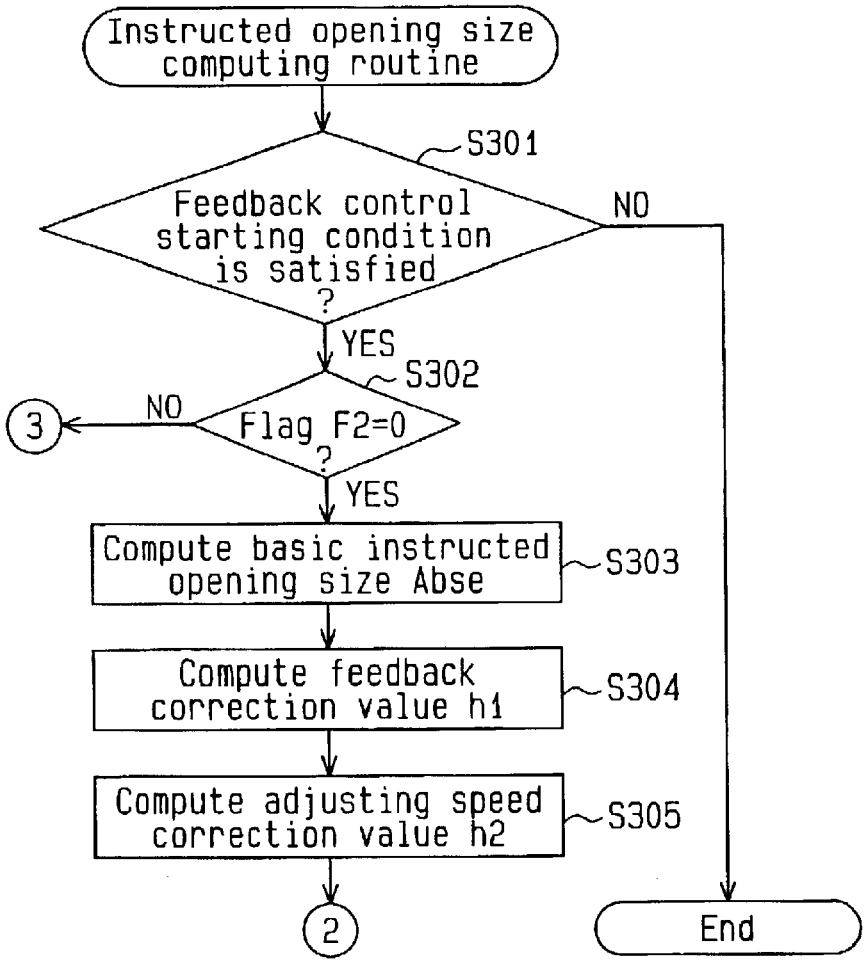
FIG. 11 is a flowchart indicating an adjusting speed correction value computing procedure according to a third embodiment.
Figure 12:
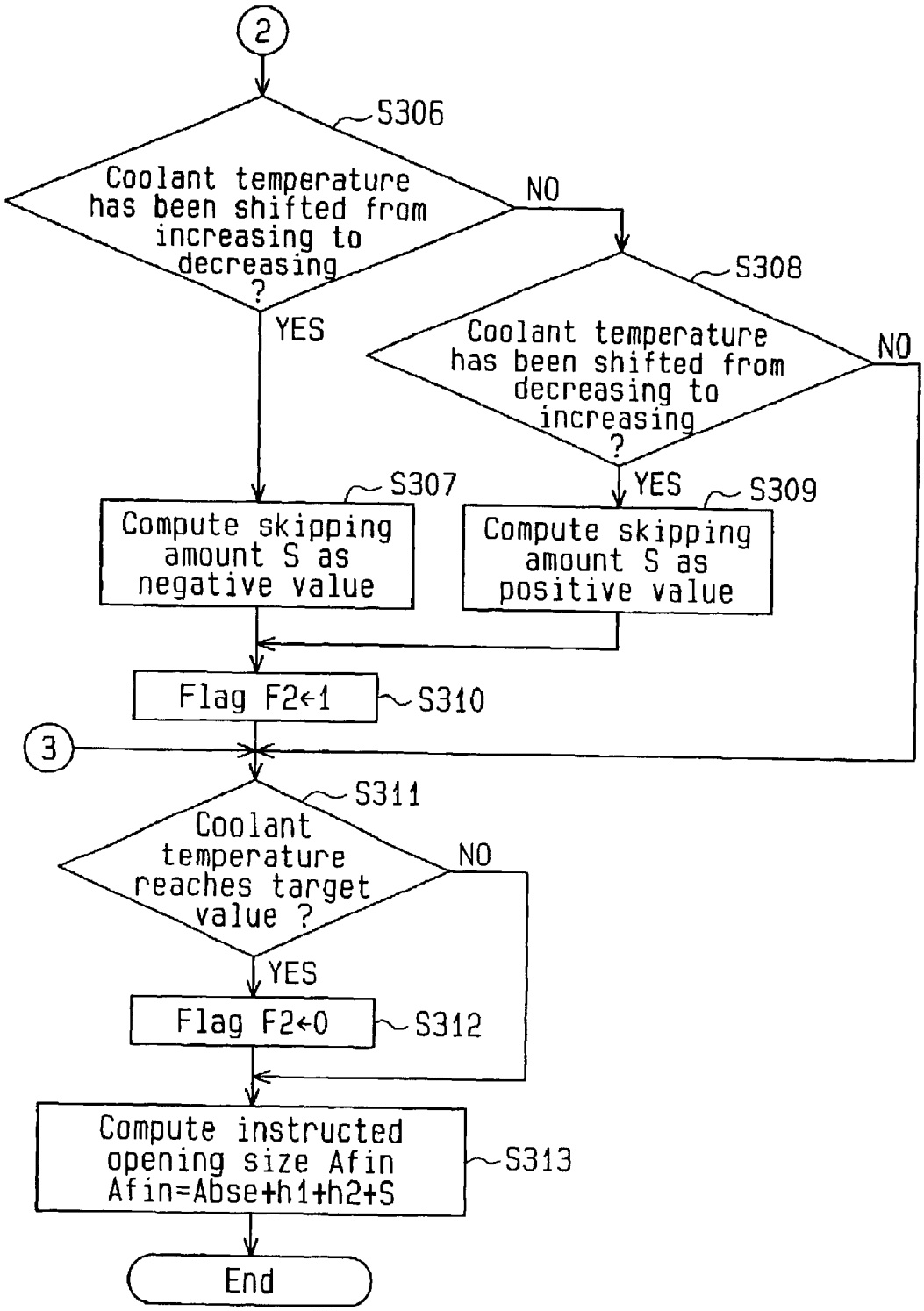
FIG. 12 is a flowchart indicating the adjusting speed correction value computing procedure according to the third embodiment.

Next, a procedure of computing the instructed opening size Afin will be described with reference to the flowcharts of FIGS. 11 and 12, which indicate the corresponding routine. In the routine, the portion corresponding to steps S301 and S303 to S305 is identical to the portion corresponding to steps S101 to S104 of the routine of FIG. 2 according to the first embodiment.

In the instructed opening size computing routine of the third embodiment, it is first judged whether or not the conditions for the feedback controlling are satisfied in step S301. If the judgment is positive (S301: YES), it is judged whether or not a flag F2 is "0" in step S302. More specifically, the flag F2 indicates whether or not the flow control valve 7 is fixed at the opening size changed in accordance with the skipping amount S. If the flag f2 is "0", it is indicated that the opening size of the flow control valve 7 is currently non-fixed.

If the judgment of S302 is positive, the basic opening size Abse, the feedback correction value h1, and the adjusting speed correction value h2 are computed in this order in steps S303, S304, and S305. Subsequently, in steps S306 to S309 of FIG. 12, the skipping amount S is computed.

Figure 13:
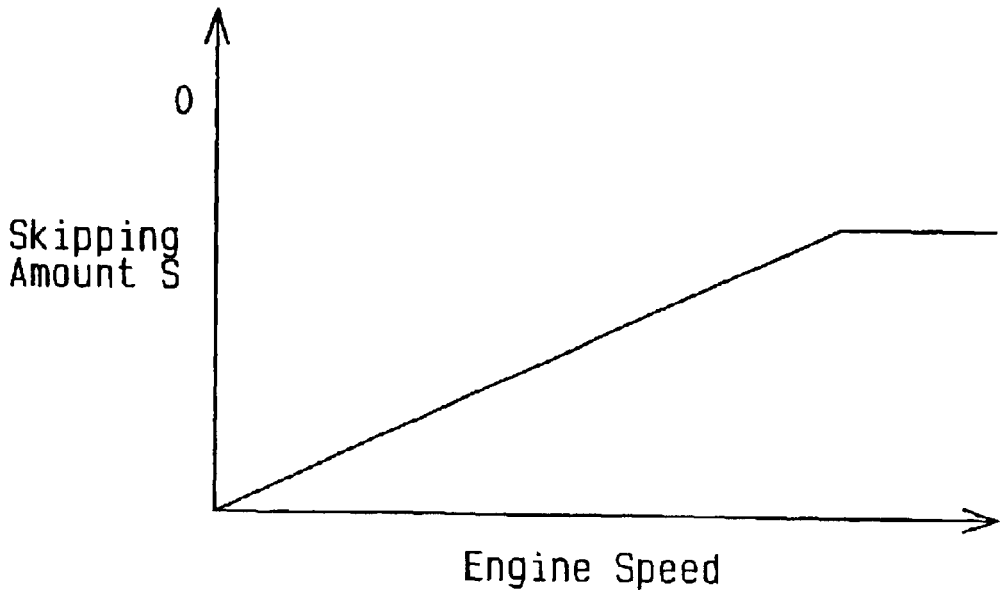
FIG. 13 is a graph indicating the changing of a skipping amount with respect to the engine speed, when the variation of the engine outlet coolant temperature is shifted from increasing to decreasing.

More specifically, in step S306, it is judged whether or not the variation of the engine outlet coolant temperature has been shifted from increasing to decreasing. If the judgment is positive (S306: YES), the skipping amount S is computed as a negative value in relation to the engine speed in step S307. With reference to FIG. 13, the skipping amount S is gradually increased with respect to "0" as the engine speed becomes greater such that the coolant displacement of the water pump 3, or the coolant flow in the coolant circuit 2, gradually increases. That is, as the coolant flow in the coolant circuit 2 becomes greater, the increasing amount of the engine outlet coolant temperature, with the opening size of the flow control valve 7 reduced in accordance with the skipping amount S, becomes greater. It is thus preferred that the skipping amount S is varied in relation to the engine speed, as described, for enabling the engine outlet coolant speed to quickly seek the target value.

Figure 14:
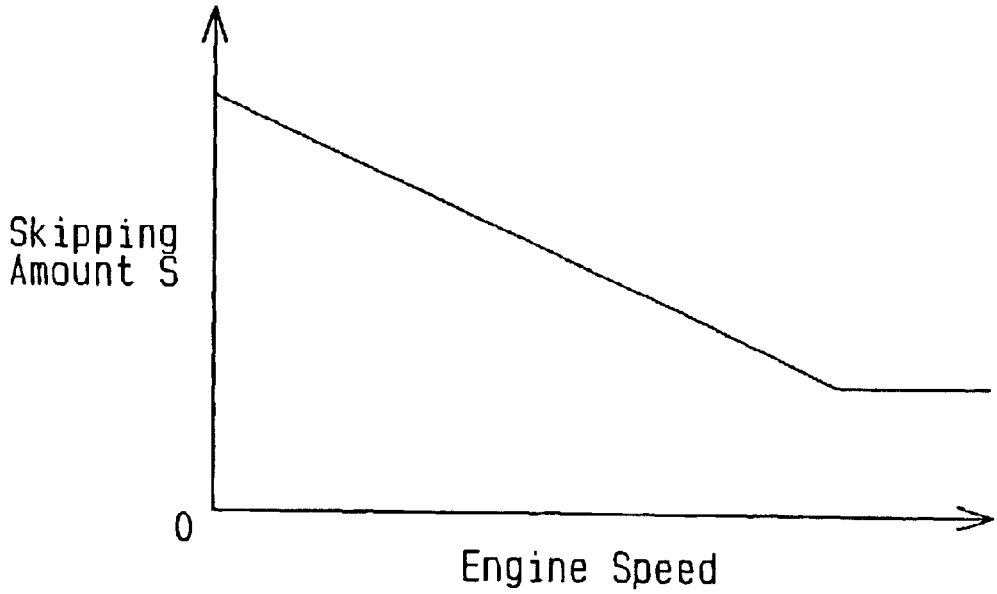
FIG. 14 is a graph indicating the changing of the skipping amount with respect to the engine speed, when the variation of the engine outlet coolant temperature is shifted from decreasing to increasing.

Further, if the judgment of S306 is negative, it is judged whether or not the variation of the engine outlet coolant temperature has been shifted from decreasing to increasing in step S308. If the judgment is positive (S308: YES), the skipping amount S is computed as a positive value in relation to the engine speed in step S309. With reference to FIG. 14, the skipping amount S is gradually decreased with respect to "0" as the engine speed becomes greater such that the coolant displacement of the water pump 3, or the coolant flow in the coolant circuit 2, increases. That is, as the coolant flow in the coolant circuit 2 becomes greater, the decreasing amount of the engine outlet coolant temperature, with the opening size of the flow control valve 7 increased in accordance with the skipping amount S, becomes greater. It is thus preferred that the skipping amount S is varied in relation to the engine speed for enabling the engine outlet coolant speed to quickly seek the target value.

If the judgments of S308 and S309 are both negative, the skipping amount S is maintained at a previously computed value.

After the skipping amount S is computed in steps S307 or S309, the flag F2 is set to "1", indicating that the flow control valve 7 is fixed at the changed opening size, in step S310. More specifically, as long as the flag F2 is held at "1", the judgment of S302 (FIG. 11) remains negative, and steps of S303 to S310 are not performed. In other words, the computation of the basic instructed opening size Abse, the feedback correction value h1, the adjusting speed correction value h2, or the skipping amount S is not performed. Thus, the flow control valve 7 is maintained at the opening size changed in accordance with the skipping amount S as long as the flag F2 remains "1".

Once the engine outlet coolant temperature reaches the target value with the flow control valve 7 fixed at the opening size changed in accordance with the skipping amount S (S311: YES), the flag F2 is reset to "0", indicating that the opening size of the flow control valve 7 is currently non-fixed. Afterwards, the instructed opening size Afin is computed in step S313.

The third embodiment has the following effects, in addition to the items (2) and (3), which have been described about the first embodiment.

(5) In the third embodiment, when the variation of the engine outlet coolant temperature is shifted between increasing and decreasing, the opening size of the flow control valve 7 is changed in accordance with the skipping amount S such that the engine outlet coolant temperature quickly seeks the target value. Thus, even if changing of the engine outlet coolant temperature in response to the opening size adjustment of the flow control valve 7 is delayed, the control reliability of the engine outlet coolant temperature with respect to the target value is prevented from being lowered due to the delayed response.

(6) When the opening size of the flow control valve 7 is changed in accordance with the skipping amount S after the variation of the engine outlet coolant temperature is shifted between increasing and decreasing, the flow control valve 7 is fixed at the changed opening size until the engine outlet coolant temperature reaches the target value. The engine outlet coolant temperature thus quickly seeks the target value.

(7) The skipping amount S is varied in relation to the engine speed, which is a parameter associated with the coolant flow in the coolant circuit 2. Thus, even if the changing amount of the engine outlet coolant temperature in response to the opening size adjustment of the flow control valve 7 is varied depending on the coolant flow in the coolant circuit 2, the opening size of the flow control valve 7 is appropriately adjusted based on the skipping amount S, regardless of the coolant flow in the coolant circuit 2. Accordingly, the engine outlet coolant temperature quickly seeks the target value.

The illustrated embodiments may be modified as follows.

In the third embodiment, the engine speed is used as the parameter associated with the coolant flow in the coolant circuit 2. However, instead of using the parameter, a flow sensor or the like may directly detect the coolant flow in the coolant circuit 2. In this case, the skipping amount S is computed as a variable value based on the detection value.

Further, the skipping amount S does not necessarily have to be variable but may be fixed.

In the third embodiment, the flow control valve 7 is fixed at the opening size changed in accordance with the skipping amount S until the engine outlet coolant temperature reaches the target value. However, the opening size of the flow control valve 7 may be fixed only for a predetermined time. Further, the time for fixing the opening size of the flow control valve 7 may be varied depending on the difference between the engine outlet coolant temperature and the target value when the variation of the engine outlet coolant temperature is shifted between increasing and decreasing.

In each of the illustrated embodiments, the adjusting speed correction value h2 does not necessarily have to be varied in relation to the difference between the engine outlet coolant temperature and the target value. Instead, the adjusting speed correction value h2 may be a fixed value.

Also, the opening size adjustment of the flow control valve 7 in accordance with the adjusting speed correction value h2 dose not necessarily have to be conducted.

In the first embodiment, the minimum opening size of the flow control valve 7 is restricted such that the opening size adjustment of the flow control valve 7 is not performed in the range A, or the relatively low opening size range close to the fully closed state. The range A may be reduced to a smaller range or enlarged to a larger range, as necessary.

The present examples and embodiments are to be considered as illustrative and not restrictive and the invention is not to be limited to the details given herein, but may be modified within the scope and equivalence of the appended claims.

What is claimed is:

1. An engine cooling system, comprising:

a coolant circuit extending through an engine, wherein coolant flows through the coolant circuit;

a radiator provided in the coolant circuit, wherein the radiator cools coolant passing through the coolant circuit;

a flow control valve, which regulates the flow rate of coolant flowing through the radiator; and a controller, wherein the controller controls the opening size of the flow control valve only during feedback control such that an engine coolant temperature, which is the temperature of coolant passing through the engine, seeks a predetermined target value, wherein, during feedback control, the controller controls the flow control valve such that the opening size of the flow control valve remains above a predetermined lowest value.

2. The cooling system according to claim 1, wherein the flow control valve has a specific opening size range in which it is difficult to cause the engine coolant temperature to seek the target value during feedback control, wherein the lowest value is determined based on the specific opening size range.

3. The cooling system according to claim 2, wherein the specific opening size range corresponds to a part of the entire opening size range of the flow control valve, in which part, the engine coolant temperature changes by an excessively great amount in relation to a change of the opening size of the flow control valve.

4. The cooling system according to claim 2, wherein the specific opening size range corresponds to a part of the entire opening size range of the flow control valve, in which part, the engine coolant temperature changes by an excessively small amount in relation to a change of the opening size of the flow control valve.

5. The cooling system according to claim 1, wherein, when the engine coolant temperature shifts from increasing to decreasing during feedback control, the controller decreases the opening size of the flow control valve by a predetermined amount from the current opening size, and wherein, when the engine coolant temperature shifts from decreasing to increasing during feedback control, the controller increases the opening size of the flow control valve by a predetermined amount from the current opening size.

6. The cooling system according to claim 5, wherein, after changing the opening size of the flow control valve by the predetermined amount, the controller maintains the changed opening size for a predetermined period.

7. The cooling system according to claim 5, wherein the controller determines the predetermined amount in accordance with a parameter related to the flow rate of the coolant in the coolant circuit.

8. The cooling system according to claim 7, wherein the parameter includes the speed of the engine.

9. The cooling system according to claim 1, wherein, when the difference between the engine coolant temperature and the target value becomes equal to or greater than a predetermined first value during feedback control, the controller starts monitoring changes of the engine coolant temperature and continues the monitoring until a predetermined period elapses, and wherein the controller adjusts the opening size of the flow control valve based on the result of the monitoring, thereby improving the response of the engine coolant temperature in seeking the target value quickly.

10. The cooling system according to claim 9, wherein, if the engine coolant temperature does not approach the target value by an amount that is equal to or greater than a predetermined second value during a period from when the difference between the engine coolant temperature and the target value becomes equal to or greater than the predetermined first value until the predetermined period elapses, the controller adjusts the opening size of the flow control valve by using a correction value for causing the engine coolant temperature to approach the target value.

11. The cooling system according to claim 10, wherein the controller determines the correction value in accordance with the difference between the engine coolant temperature and the target value.

12. An engine cooling system, comprising:

a coolant circuit extending through an engine, wherein coolant flows through the coolant circuit;

a radiator provided in the coolant circuit, wherein the radiator cools coolant passing through the coolant circuit;

a flow control valve, which regulates the flow rate of coolant flowing through the radiator; and a controller, wherein the controller controls the opening size of the flow control valve only during feedback control such that an engine coolant temperature, which is the temperature of coolant passing through the engine, seeks a predetermined target value, wherein the flow control valve has a specific small opening size range in which it is difficult to cause the engine coolant temperature to seek the target value during feedback control, and wherein, during feedback control, the controller limits the moving range of the flow control valve to prevent the flow control valve from falling in the small opening size range.

13. An engine cooling system, comprising:

a coolant circuit extending through an engine, wherein coolant flows through the coolant circuit;

a radiator provided in the coolant circuit, wherein the radiator cools coolant passing through the coolant circuit;

a flow control valve, which regulates the flow rate of coolant flowing through the radiator; and a controller, wherein feedback from the controller controls the opening size of the flow control valve such that an engine coolant temperature, which is the temperature of coolant passing through the engine, seeks a predetermined target value, wherein, when the engine coolant temperature shifts from increasing to decreasing during feedback control, the controller decreases the opening size of the flow control valve by a predetermined amount from the current opening size, and wherein, when the engine coolant temperature shifts from decreasing to increasing during feedback control, the controller increases the opening size of the flow control valve by a predetermined amount from the current opening size.

14. The cooling system according to claim 13, wherein, after changing the opening size of the flow control valve by the predetermined amount, the controller maintains the changed opening size for a predetermined period.

15. The cooling system according to claim 13, wherein the controller determines the predetermined amount in accordance with a parameter related to the flow rate of the coolant in the coolant circuit.

16. The cooling system according to claim 15, wherein the parameter includes the speed of the engine.

17. The cooling system according to claim 13, wherein, when the difference between the engine coolant temperature and the target value becomes equal to or greater than a predetermined first value during feedback control, the controller starts monitoring changes of the engine coolant temperature and continues the monitoring until a predetermined period elapses, and wherein the controller adjusts the opening size of the flow control valve based on the result of the monitoring, thereby improving the response of the engine coolant temperature in seeking the target value quickly.

18. The cooling system according to claim 17, wherein, if the engine coolant temperature does not approach the target value by an amount that is equal to or greater than a predetermined second value during a period from when the difference between the engine coolant temperature and the target value becomes equal to or greater than the predetermined first value until the predetermined period elapses, the controller adjusts the opening size of the flow control valve by using a correction value for causing the engine coolant temperature to approach the target value.

19. The cooling system according to claim 18, wherein the controller determines the correction value in accordance with the difference between the engine coolant temperature and the target value.

* * * * *